United States Patent [19]

Wey

[11] Patent Number: 4,928,895

[45] Date of Patent: May 29, 1990

[54] METHOD AND APPARATUS FOR ASSEMBLING A PLURALITY OF PACKAGES FOR TRANSPORT ALONG A TEXTILE MACHINE

[75] Inventor: Edmund Wey, Nettetal, Fed. Rep. of Germany

[73] Assignee: W. Schlafhorst & Co., Fed. Rep. of Germany

[21] Appl. No.: 330,452

[22] Filed: Mar. 30, 1989

[30] Foreign Application Priority Data

Mar. 30, 1988 [DE] Fed. Rep. of Germany ..... 3810773

[51] Int. Cl.[5] ..... B65H 67/04; B65H 67/06

[52] U.S. Cl. ..... 242/35.5 A; 198/347; 242/35.5 R

[58] Field of Search ..... 242/35.5 R, 35.5 A; 901/7; 414/751; 198/351, 353, 354, 370, 347, 468.6, 469.1, 470.1, 476.1

[56] References Cited

U.S. PATENT DOCUMENTS 4,029,215 6/1977 Birdwell ..... 198/468.6 X
4,657,194 4/1987 Wey et al. ..... 242/35.5 A
4,690,342 9/1987 Langen ..... 198/347 X
4,730,733 3/1988 Kawamura et al. ..... 198/351 X
4,810,155 3/1989 D'Agnolo ..... 242/35.5 A X

FOREIGN PATENT DOCUMENTS 3418814 11/1985 Fed. Rep. of Germany ..... 242/35.5 A

*Primary Examiner*—Donald Watkins
*Attorney, Agent, or Firm*—Shefte, Pinckney & Sawyer

[57] ABSTRACT

A method and apparatus for transporting packages from stations of a textile machine to a location for further handling or processing includes a package support device. Packages are transferred from the winding station to the package support device and, when a plurality of packages are supported on the package support device, the package support device places the plurality of packages selectively onto one of a pair of package transport devices for transport of the plurality of packages from the stations to a location for further handling or processing. The package support device supports the plurality of packages at a clearance with respect to the pair of package transport devices sufficient to permit the package transport devices to transport packages therepast.

13 Claims, 5 Drawing Sheets

METHOD AND APPARATUS FOR ASSEMBLING A PLURALITY OF PACKAGES FOR TRANSPORT ALONG A TEXTILE MACHINE

BACKGROUND OF THE INVENTION

The present invention relates to a method and apparatus for transporting packages from winding stations of a textile machine to a location for further handling or processing.

The winding stations of certain textile machines can be operated to build cross-wound packages and these cross-wound packages are transported to locations for handling or processing, such as yarn twisting or doubling machines which combine yarn from a pair of cross-wound packages. If a pair of corss-wound packages are to be combined at a doubling machine, it is advantageous if the cross-wound package supplying the cover yarn has a greater amount of yarn than the other cross-wound package of the pair, which supplies the core yarn. To this end, one economical configuration of the winding stations for producing the cross-wound packages is a configuration in which the individual winding stations alternately produce cross-wound packages of different lengths or in which certain winding stations produce packages of one length while other winding stations produce packages of a different length.

To expedite the transport and identification of the cross-wound packages of different characteristics for subsequent processing, it is advantageous to maintain the cross-wound packages of each characteristic separate.

SUMMARY OF THE INVENTION

The present invention provides a method and apparatus for maintaining cross-wound packages of different characteristics separate during their travel between the winding stations of a winding machine and a location for further handling or processing.

Briefly described, the present invention provides a method for use in the operation of a textile machine of this type having a plurality of winding stations for building yarn packages and a pair of independently operable package transporting devices for transporting packages from the stations to a location for further handling or processing. The method includes transferring a plurality of packages from the station to a package support means, maintaining the package support means, and the packages supported thereon, at a clearance from the pair of package transport devices, sufficient to permit the devices to transport packages therepast and placing the plurality of packages from the package support means selectively onto either one of the pair of package transport devices for transporting the plurality of packages by the selected package transport device from the stations to the location for further handling or processing.

In the embodiment illustrated, in the transferring, the plurality of packages are transferred from a plurality of stations to the package support means. Preferably, in the maintaining, the package support means is maintained at the clearance until a predetermined number of packages have been transferred thereto.

The method includes operating the selected package transporting device to transport the plurality of packages thereon out of interference with placing of a subsequent plurality of packages on the selected package transporting device. If the stations of the textile machine are capable of winding packages of different characteristics, the method includes placing a plurality of packages of one characteristic onto one of the pair of package transporting devices and placing a plurality of packages of another characteristic onto the other of the pair of package transporting devices.

According to one aspect of the present invention, in the transferring, the number of packages transferred is equal to one less than the number of packages desired to be transported to the location for further handling or processing and the method further includes transferring one package directly to the selected package transporting device. Preferably, the selected package transporting device is operated subsequent to the transference thereto of the one package.

The present invention also provides an apparatus for use in a textile machine of the type having a plurality of winding stations, a device for transferring yarn packages from the winding stations and a pair of independently operable package transporting devices for transporting packages from the stations to a location for further handling or processing. The apparatus includes package support means for supporting a plurality of packages transferred thereto from the stations by the package transfer device, means for maintaining the package support means at a clearance from the pair of package transporting devices sufficient to permit the package transporting devices to transport packages therepast and means for manipulating the package support means to place the plurality of packages supported on the package support means selectively onto either one of the pair of package transporting devices for transporting the plurality of packages by the selected package transporting device from the stations to the location for further handling or processing. In the embodiment illustrated, the package support means includes a pair of rods, each rod being mounted to the free-end portion of an arm, the rods being maintained generally parallel to one another in a direction generally transverse to the package transfer direction for transfer thereto of the plurality of packages and the manipulating means includes means for moving the arm relative to one another to release the plurality of packages from the rods. The manipulating means additionally includes a housing, a means for selectively moving the housing and a vertically movable post. The arms are movably mounted to the housing and the housing is mounted on the means for selectively moving the housing for movement with respect to the package transfer direction. The selective moving means is mounted on the vertically movable post for selectively vertically moving the housing.

DETAILED DESCRIPTION OF THE PREFERRED EMBODIMENTS

Figure 1:
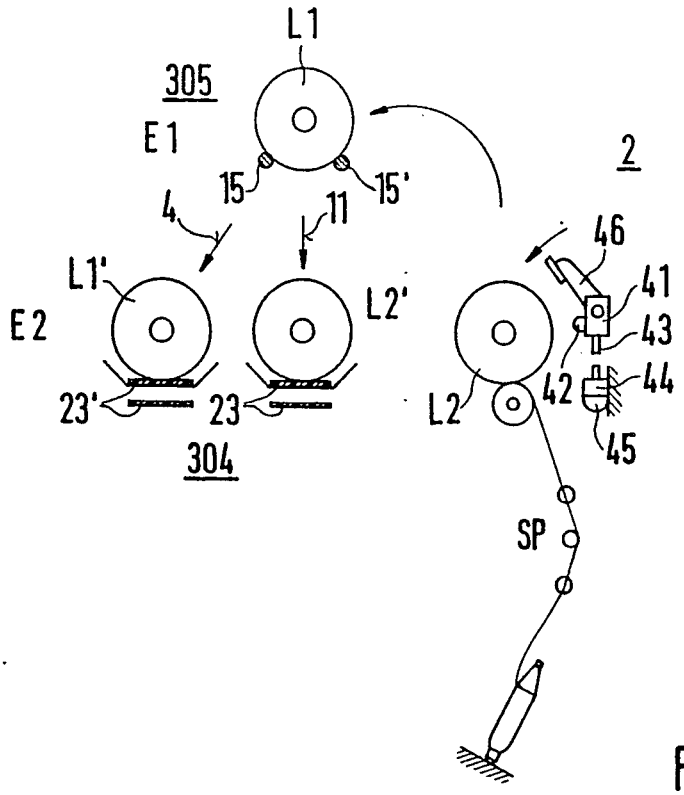
FIG. 1 is a schematic representation of one preferred embodiment of the transport apparatus of the present invention.
Figure 2:
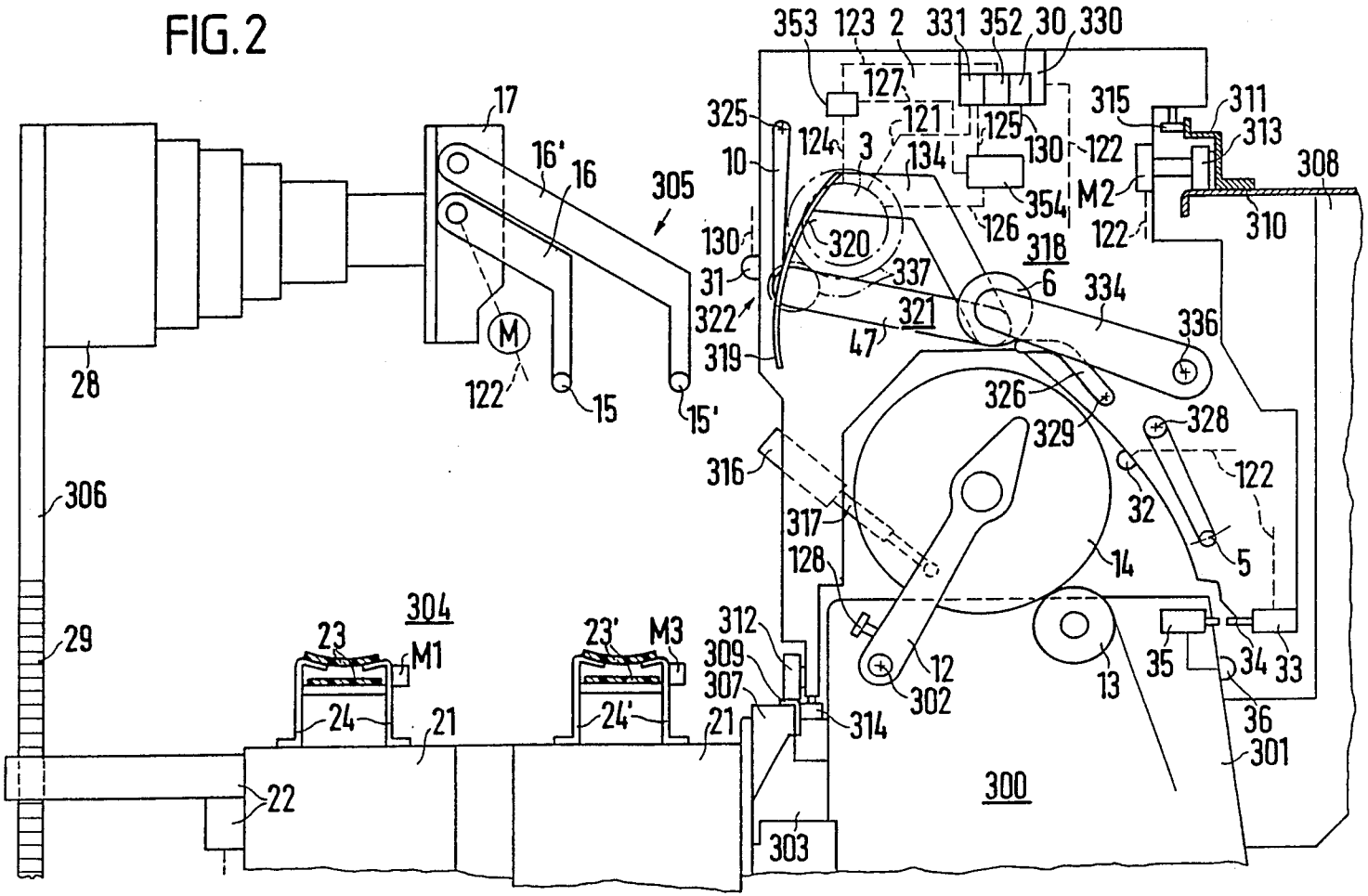
FIG. 2 is a side elevational view of one preferred embodiment of the transport apparatus of the present invention.

In FIGS. 1–5, one preferred embodiment of the transport apparatus and method of the present invention is illustrated. In FIG. 2, an automatic textile winding machine 300 is illustrated having a series of winding stations 301, only the first of which is illustrated, the others being of identical construction. The winding stations 301 are serviced by a traveling service unit 2. The structure and operation of the winding station 301 and traveling service unit 2 are conventional.

The winding stations 301 are connected to a transport frame 21 by a connecting frame 303. A package transporting device 304 includes a pair of conveyor belts 23,23' respectively supported on the transport frame 21 by brackets 24,24'. The conveyor belts 23,23' are spaced from one another in the package transfer direction and extend generally parallel to one another. Each conveyor belt 23,23' extends to a location (not shown) for further handling or processing of the cross-wound packages. A package support means 305 is supported on a vertical post 306 above the package transporting device 304. The package support means 305 includes two horizontally extending, parallel rods 15,15' projecting from arms 16,16', respectively, that are coupled to housings 17 supported on selectively extendable and retractable pneumatic cylinder assemblies 28 at the first and last winding stations and mounted to and projecting horizontally from said vertical posts 306.

Each vertical post 306 includes a threaded portion 29 which is meshingly engaged by a gear (not shown) drivingly operated by a motor 22 mounted on the machine frame 21. Each vertical post 306 is selectively vertically movable through the operation of the motor 22 to drivingly operate the gear which meshes with the threaded portion 29 of the vertical post 306 to move the package support means 305 vertically.

The pair of parallel rods 15,15' extend from a respective assembly 28 a distance sufficient to support a plurality of cross-wound packages transferred thereto by the traveling service unit 2 in end-to-end disposition. The arms 16,16' and the parallel rods 15,15' form a releasable support means for supporting a plurality of packages transferred thereto by the traveling service unit 2.

Figure 5:
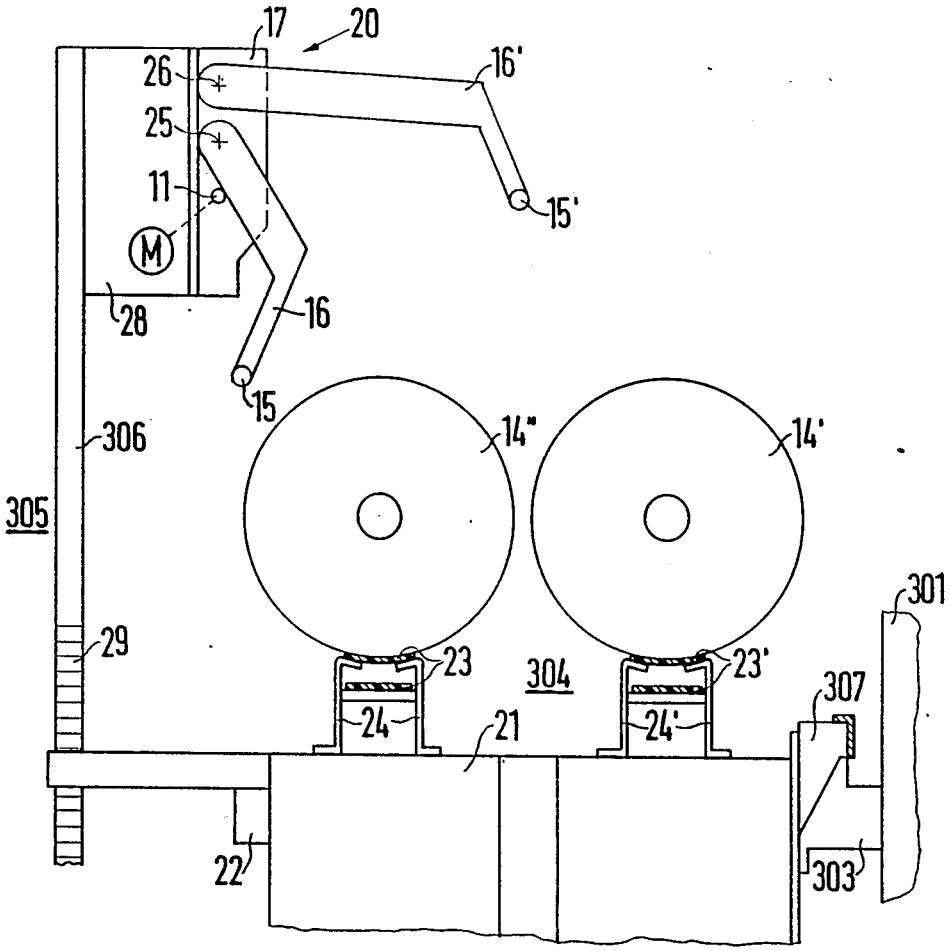
FIG. 5 is a side elevational view of the transport apparatus shown in FIG. 2.

The arms 16 and 16' extend at a downward inclination from the housing 17 with one arm 16' mounted about the other arm 16 and being longer so that the rods 15,15' at their respective ends are disposed generally in the same horizontal plane for the common support of a plurality of packages at a clearance above the conveyor belt 23. The arm 16' is pivotally connected to the housing 17 at a pivot point 26 and the arm 16 is pivotally connected to the housing 17 at a pivot point 25. Additionally, the arm 16 and 16' are arranged such that the rod 15 on the arm 16 rotates or pivots in an arcuate path toward the left (as seen in FIG. 5) while the rod 15' on the arm 16' pivots in a correspondingly greater arc to the right to package releasing positions. Both rods are swingable back along their respective arcuate paths to return to their initial package supporting positions. In this manner, the arms 16,16' and the rods 15,15' cooperate together to releasably support the packages 14 transferred thereto.

Each housing 17 houses a gear assembly 20 that includes three gears arranged vertically above one another. A synchronization shaft 11 is connected to the gear assemblies 20 and connects the vertically lowest gear to the corresponding gears at the respective winding stations so that the operation of the gear assemblies at both of the winding stations are synchronized. The synchronization shaft 11 is driven by a motor M, shown in FIG. 5. The arm 16 is connected to the middle gear and the arm 16' is connected to the vertically uppermost gear.

A sensor 32 mounted to the traveling service unit 2 monitors the condition of the package 14 at the winding station 301. The sensor 32 is operatively connected by a branch of the lead 122 to a solenoid 33 mounted on the traveling service unit 2. The sensor 32 determines if the package 14 has achieved the appropriate size and determines, if desired, the category to which the package belongs in accordance with its particular characteristics, such as the amount of yarn. Since the lead 122 is connected to the control device 330, the monitoring information obtained by the sensor 32 is communicated to the control device 330. Accordingly, the control device 330 controls the operation of the traveling service unit 2 to transfer the package 14 to the parallel rods 15,15' once the package 14 has achieved the desired dimensions. If the sensor 32 determines that the package 14 is unsuitable, the control device 330 activates the solenoid 33 to cause its plunger 34 to contact a microswitch 35 mounted on the winding station 301. The microswitch 35 is connected to a disturbance indicator light 36 and this light is activated when the microswitch is contacted by the plunger 34, whereby an operator is alerted to check the winding station 301 for problems thereat.

In FIG. 1, an automatic sensing unit 41 includes a sensor 42 which monitors a full cross-wound package L2 standing ready at the winding station 301 for transfer to the transport apparatus of the present invention. The sensor 42 performs a two-part determination. First, the second determines if a cross-wound package is available at a particular winding station being sensed, designated as winding station SP, and, secondly, if a cross-wound package is available at the winding station, the sensor 42 determines if the cross-wound package is of a proper size. Additionally, the sensor 42 determines if the package is of a particular characteristic, such as, for example, of a greater amount of yarn. If there is no package at the sensed winding station of an appropriate size for transfer to the transport apparatus, the automatic sensing unit 41 activates a solenoid 43 which cooperates with a microswitch 44 mounted to the winding station SP. The contact of the solenoid 43 and the microswitch 44 closes a circuit which supplies power to a disturbance indicator lamp 45 at the station. Accordingly, an operator can be alerted by the illumination of the disturbance indicator lamp 45 to check the operation at the winding station SP to remedy the package building problems thereat.

If the sensor 42 determines that a package is available at the winding station SP, such as a package L2, but determines that the package is defective in some manner, a labeling unit 46 is activated. The labeling unit 46 includes a pivoting arm which pivots in the direction of the arrow shown in FIG. 1 to apply a label to the package L2 so that an operator can later identify and/or segregate the labeled packages. Additionally, the disturbance indicator lamp 45 can be actuated in the event a level is applied to a defective package.

Figure 3:
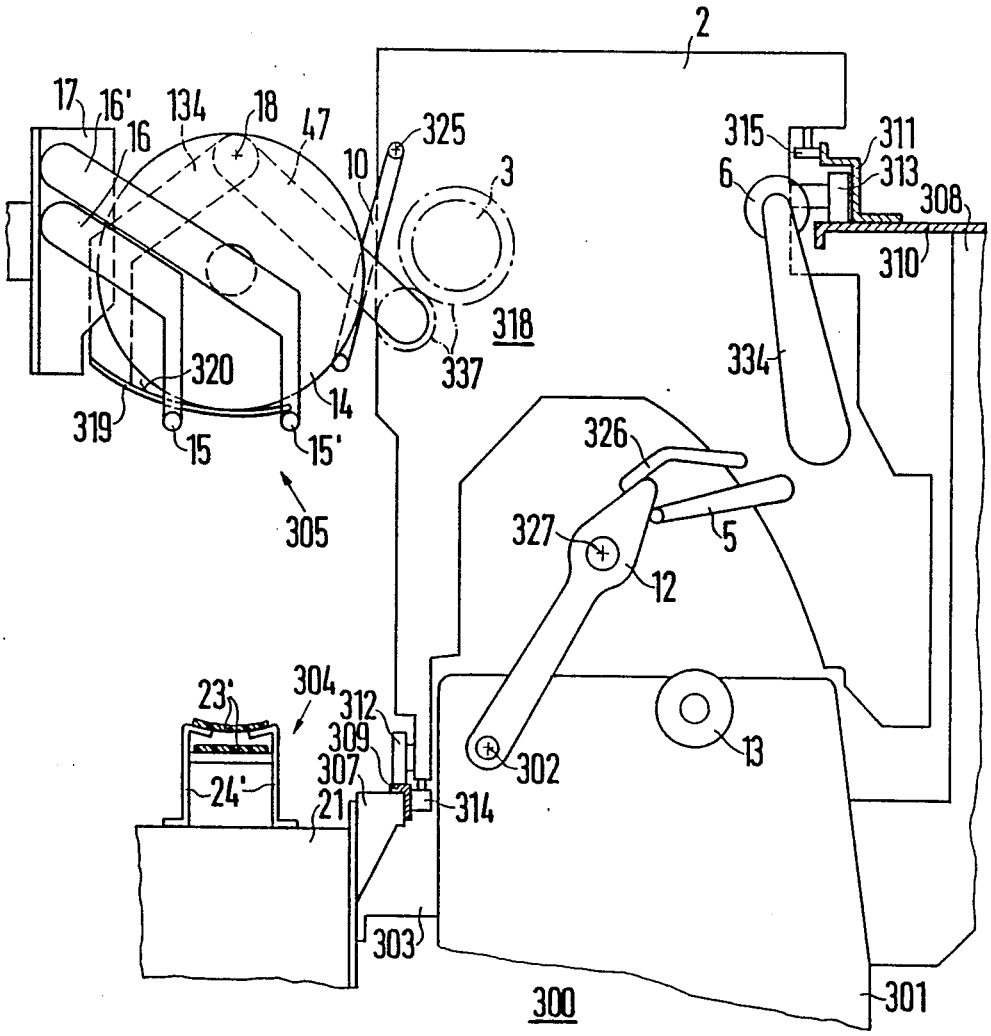
FIG. 3 is a partial side elevational view of the transport apparatus shown in FIG. 2, showing a package being transferred by a traveling service unit from a winding station to the transport apparatus.
Figure 4:
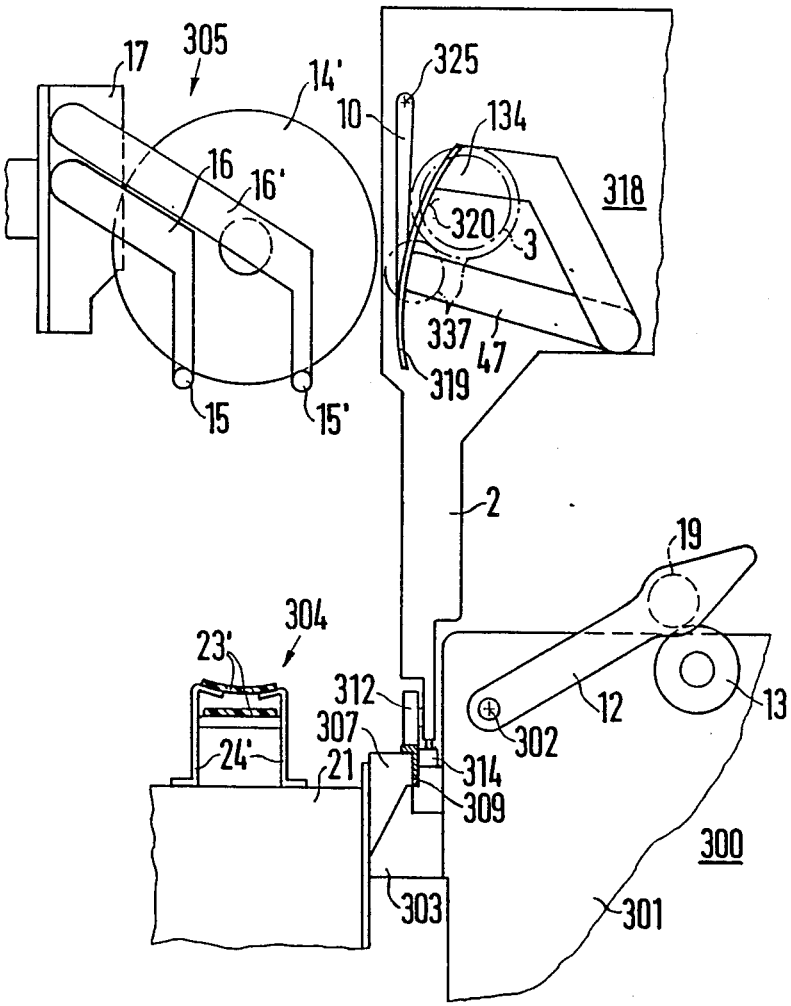
FIG. 4 is a partial side elevational view of the transport apparatus shown in FIG. 3, showing a package being supported by the transport apparatus.

In operation, traveling service unit 2 engages a package 14 at the winding station 301 with its carrier member 319 for transfer thereof to the package support means 305. As shown in FIG. 3, the traveling service unit 2 controls the movement of its carrier member 319 to support the package 14 immediately above the parallel rods 15,15'. Thereafter, the carrier member 319 is retracted from underneath the package 14 and the package 14 falls under its own weight onto the rods 15,15' to be supported thereon. In this respect, the stop member 10 of the traveling service unit 2 is located on the side of the package opposite the direction of the carrier member retraction. The carrier member 319 is then returned to its initial position (shown in FIG. 4) and the winding station 301 begins to wind a new package on a newly inserted empty winding core 19.

In the event that the winding station 301 is configured to alternately produce packages of different characteristics, such as packages with different amounts of yarn, the winding station 301 will produce the next package with a different characteristic. In the meantime, the service unit 2 travels to other winding stations to retrieve packages of the same characteristic as the package 14 supported on the package support means 305 and to transfer these packages to the package support means 305 at the respective winding stations. Once a desired plurality 14' of the packages 14 has been transferred to the package support means 305, the package support means is moved to a position in which it can place the plurality 14' onto either one of the conveyor belts 23 or 23' for transport of the plurality of packages to the location for further handling or processing. If, for example, it is desired to place the plurality 14' onto the conveyor 23', the motor 22 is operated to lower the vertical post 306 and, thus, lower the package support means 305 to a position in which the packages of the plurality 14' are supported immediately above the conveyor belt 23'. Thereafter, the arm 16,16' are swung outwardly from one another by operation of the gear assembly 20 in the housing 17 to release the supported packages onto the conveyor belt 23'. With this arms 16,16' in their outwardly pivoted positions, the motor 22 is then operated to raise the vertical post 306 to return the package support means 305 to its package receiving position at a clearance from the package transport device 304 sufficient to permit the conveyors 23,23' to transport packages deposed thereon past the package support means without interference. Once the arms 16,16' clear the packages of the plurality 14', the motor M in the housing 17 is operated to pivot the arms toward one anoter to again bring the rods 15,15' into package receiving position. Thereafter, the traveling service unit transfers packages from the winding stations 301 to the package support means 305 to form a second plurality 14'' of packages supported on the package support means 305.

Preferably, the packages which comprise the plurality 14'' can be of a different characteristic than the packages which comprise the plurality 14' such as, for example, the packges of one plurality can have a greater amount of yarn on them than on the packages of the other plurality. Once a predetermined plurality 14'' of packages of a second characteristic have been transferred onto the package support means 305, the pneumatic cylinder assembly 28 is operated to move the housing 17 in the package transfer direction until the packages are aligned with the conveyor belt 23. Then, the motor 23 is actuated to lower the vertical post 306 to bring the package support means 305 into a position for releasing the packages of the plurality 14'' onto the conveyor belt 23. The motor M in the housing 17 is then actuated to pivot the arms 16,16' away from one another to release the packages of the plurality 14'' onto the conveyor belt 23. Thereafter, the motor 22 can be actuated to raise the vertical post 306 so that the rods 15,15' clear the packages of the plurality 14'', as shown in FIG. 5.

The control device 330 controls the package transporting device 304 to transport the two pluralities 14',14'' of packages to the location for further handling or processing before a new plurality of packages are transferred to either of the package transport devices 304. Thus, a pair of plurality of packages, each plurality having packages of a different characteristic, can be delivered separately to the location for further handling or processing.

For efficient operation in a minimum of time the apparatus can be used to transfer the last of a predetermined plurality of packages without requiring use of the package support means 305. In this manner the predetermined number of packages can be selected to be one less than the number of packages desired to be transported to the location for further handling or processing, and the control device 330 then controls the traveling service unit 2 to manipulate the carrier member 319 to transfer a package from one of the winding stations 301 directly to a selected one of the conveyor belt 23,23' to fulfill the transportation requirement.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing diclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In the operation of a textile machine of the type having a plurality of winding stations for building yarn packages and a pair of independently operable package transporting devices for transporting packages from the stations to a location for further handling or processing, a method comprising:

transferring a plurality of packages from the stations to a package support means;

maintaining said package support means, and said packages supported thereon, at a clearance from said pair of package transport devices sufficient to permit said devices to transport packages therepast; and placing said plurality of packages from said package support means selectively onto either one of said pair of package transport devices for transporting said plurality of packages by said selected packages transport device from said stations to the location for further handling or processing.

2. In the operation of a textile machine, a method according to claim 1 and characterized further in that, in said transferring, said plurality of packages and transferred from a plurality of stations to said package support means.

3. In the operation of a textile machine, a method according to claims 1 or 2 and characterized further in that, in said maintaining, said package support means is maintained at said clearance until a predetermined number of packages have been transferred thereto.

4. In the operation of a textile machine, a method according to claim 1 and characterized further by operating said selected package transporting device to transport said plurality of packages thereon out of interference with placing of a subsequent plurality of packages on said selected package transporting device.

5. In the operation of a textile machine, a method according to claim 1 wherein said stations are capable of winding packages of different characteristics and characterized further in that, in said placing, a plurality of packages of one characteristic are placed onto one of said pair of package transporting devices and a plurality of packages of another characteristic are placed onto the other of said pair of package transporting devices.

6. In the operation of a textile machine, a method according to claim 5 and characterized further by operating said package transporting devices after a predetermined equal number of packages have been placed on both package transporting devices.

7. In the operation of a textile machine, a method according to claim 1 and characterized further in that, in said transferring, the number of packages transferred is equal to one less than the number of packages desired to be transported to the location for further handling or processing and characterized further by transferring one package directly from one of the winding stations to said selected package transporting device without intermediately supporting said one package on one of said package support means.

8. In the operation of a textile machine, a method according to claim 7 and characterized further in that said selected package transporting device is operated subsequent to the transference thereto of said one package.

9. An apparatus for use in a textile machine of the type having a plurality of winding stations, a device for transferring yarn packages from the winding stations and a pair of independently operable package transporting devices for transporting packages from the stations to a location for further handling or processing, comprising:

package support means for supporting a plurality of packages transferred thereto from the stations by the package transfer device;

means for maintaining said package support means at a clearance from said pair of package transporting devices sufficient to permit said package transporting devices to transport packages therepast; and means for manipulating said package support means to place said plurality of packages supported on said package support means selectively onto either one of said pair of package transporting devices for transporting said plurality of packages by said selected package transporting device from said stations to the location for further handling or processing.

10. An apparatus according to claim 9 and characterized further in that said means for manipulating said package support means includes means for manipulating its package support means to place said packages supported thereon onto said selected package transporting device when the number of packages supported by said package support means is equal to one less than the number of packages desired to be transported to the location for further handling or processing, whereby the last package is transferred directly from the winding station directly to said selected package transporting device after said packages have been placed on said selected package transporting device.

11. An apparatus according to claim 9 and characterized further in that said package support means includes a pair of rods, each rod being mounted to the free-end portion of an arm, said rods being maintained generally parallel to one another in a direction generally transverse to the package transfer direction for transfer thereto of said plurality of packages, and in that said manipulating means includes means for moving said arms relative to one another to release said plurality of packages from said rods.

12. An apparatus according to claim 11 and characterized further in that said manipulating means includes a housing, a means for selectively moving said housing and a vertically movable post, said arms being movably mounted to said housing, said housing being mounted on said means for selectively moving said housing for movement with respect to the package transfer direction and said means for selectively moving said housing being mounted on said vertically movable post for selectively vertically moving said housing.

13. An apparatus for use in a textile machine of the type having a plurality of winding stations, a device for transferring yarn packages from the winding stations and a pair of independently operable package transporting devices for transporting packages from the stations to a location for further handling or processing, comprising:

package support means for supporting a plurality of packages transferred thereto from the stations by the package transfer device, said package support means, the winding station and at least a portion of each of said package transporting devices being co-extensive with one another;

means for maintaining said package support means at a vertical clearance from the co-extensive portions of said pair of package transporting devices sufficient to permit said package transporting devices to transport packages therepast; and means for manipulating said package support means to place said plurality of packages supported on said package support means selectively onto the co-extensive portion of a selected one of said pair of package transporting devices for transporting said plurality of packages by said selected package transporting device from the winding stations to the location for further handling or processing.

* * * * *